US007600317B2

(12) United States Patent
Matsuyama et al.

(10) Patent No.: US 7,600,317 B2
(45) Date of Patent: Oct. 13, 2009

(54) MANUFACTURING METHOD OF INK-JET HEAD

(75) Inventors: Toshiya Matsuyama, Tajimi (JP); Tatsuo Terakura, Nagoya (JP); Yutaka Ando, Ama-gun (JP)

(73) Assignee: Brother Kogyo Kabushiki Kaisha (JP)

( * ) Notice: Subject to any disclaimer, the term of this patent is extended or adjusted under 35 U.S.C. 154(b) by 493 days.

(21) Appl. No.: 11/157,988

(22) Filed: Jun. 22, 2005

(65) Prior Publication Data

US 2005/0278951 A1 Dec. 22, 2005

(30) Foreign Application Priority Data

Jun. 22, 2004 (JP) ..... 2004-184058

(51) Int. Cl.
*B21D 53/76* (2006.01)

(52) U.S. Cl. ..... 29/890.1; 156/323

(58) Field of Classification Search ..... 156/323; 29/890.1; 347/47

See application file for complete search history.

(56) References Cited

U.S. PATENT DOCUMENTS 5,439,728 A * 8/1995 Morozumi et al. ..... 428/136
6,187,245 B1 * 2/2001 Hedley ..... 264/314

FOREIGN PATENT DOCUMENTS

| | | | |
|---|---|---|---|
| JP | 57-157764 | | 9/1982 |
| JP | 58163667 | A * | 9/1983 |
| JP | 1042247 | B2 | 2/1989 |
| JP | 4-358841 | | 12/1992 |
| JP | 04358841 | A * | 12/1992 |
| JP | 7-205430 | | 8/1995 |

OTHER PUBLICATIONS

Abstract for JP 58163667 1983.*
Abstract for JP 04358841 1992.*
Japanese Office Action dated Oct. 10, 2006 in Application No. 2004-184058, No translation.

* cited by examiner

*Primary Examiner*—John L Goff
(74) *Attorney, Agent, or Firm*—Banner & Witcoff, Ltd.

(57) ABSTRACT

A manufacturing method of an ink-jet head comprises the steps of: laminating with an adhesive a first plate having a nozzle hole that ejects an ink droplet and a second plate having a communication hole; and applying pressure to the first and second plates in their laminated direction. In the step of laminating, an opening of the nozzle hole is included within an opening of the communication hole on an interface between the first plate and the second plate. In the step of applying pressure, pressure is applied to only a region outside of the opening of the communication hole with respect to a plane parallel to planes of the first and second plate.

7 Claims, 14 Drawing Sheets

MANUFACTURING METHOD OF INK-JET HEAD

This application claims priority to Japanese Patent Application No. 2004-184058, filed Jun. 22, 2004, whose contents are expressly incorporated herein by reference.

BACKGROUND OF THE INVENTION

1. Field of the Invention

The present invention relates to a manufacturing method of an ink-jet head having nozzle holes that eject ink droplets to a recording medium.

2. Description of Related Art

An ink-jet head has a nozzle plate in which many nozzle holes are formed. Ink droplets are ejected from the nozzle holes to a recording medium and land on the recording medium, so that a desired image is formed thereon. This type of ink-jet head also has ink passages that communicate with the respective nozzle hole. The ink passages are formed by laminating and bonding thin etched plates each having a plurality of communication holes formed therein. In order to bond an etched plate and a nozzle plate with good accuracy, according to a known technique, a gap material is buried in an adhesive film that is interposed between the etched plate and the nozzle plate (see Japanese Patent No. 3189844). In this technique, compression of the adhesive film upon pressure application is restricted to a constant amount due to a thickness of the gap material. Therefore, a space between the etched plate and the nozzle plate can be kept substantially equal.

However, a diameter of a communication hole, which is connected to a nozzle hole, is larger than a diameter of the nozzle hole. Thus, stress applied to an overhang which is formed around each nozzle hole of the nozzle plate and faces the communication hole inevitably concentrates on a portion of the nozzle plate, on the side facing the etched plate, corresponding to an outer edge of an opening of the communication hole. This makes it difficult to reliably prevent an adhesive such as the adhesive film from bulging into the communication hole. The adhesive, which has bulged into the communication hole, may further flow into the nozzle hole, and as a result may block the nozzle hole or cause troubles about ink ejection from the nozzle hole. In order to prevent such bulging of the adhesive, it is necessary to tightly control conditions such as a kind of adhesive, the amount of adhesive, a temperature in adhesion, pressure applied to the nozzle plate and the etched plate, and the like. In this case, however, a manufacturing cost is increased.

SUMMARY OF THE INVENTION

An object of the present invention is to provide a manufacturing method of an ink-jet head that can prevent an adhesive from flowing into a nozzle hole.

According to a first aspect of the present invention, there is provided a manufacturing method of an ink-jet head, comprising the steps of: laminating with an adhesive a first plate having a nozzle hole that ejects an ink droplet and a second plate having a communication hole so that, on an interface between the first plate and the second plate, an opening of the nozzle hole is included within an opening of the communication hole; and applying pressure to the first and second plates in their laminated direction so that the pressure is applied to only a region outside of the opening of the communication hole with respect to a plane parallel to planes of the first and second plate.

According to a second aspect of the present invention, there is provided a manufacturing method of an ink-jet head, comprising the steps of: laminating with an adhesive a first plate having a nozzle hole that ejects an ink droplet and a second plate having a communication hole so that, on an interface between the first plate and the second plate, an opening of the nozzle hole is included within an opening of the communication hole; and applying pressure to the first and second plates in their laminated direction so that the pressure is applied to only a region outside of an outline with respect to a plane parallel to planes of the first and second plate, the outline being formed by projecting an outer edge of the opening of the communication hole on the interface along a thickness of the first plate onto an ink ejection face of the first plate opposite to a face thereof bonded to the second plate.

In the first and second aspects mentioned above, in the step of applying pressure, reduced stress is applied to an overhang which is formed around the nozzle hole of the first plate and faces the communication hole of the second plate. Accordingly, an adhesive disposed between the first plate and the second plate can be prevented from bulging into the communication hole and further flowing into the nozzle hole. This can prevent the adhesive from blocking the nozzle hole or causing ink ejection troubles without any tight control over conditions such as a kind of adhesive, the amount of adhesive, a temperature in adhesion, pressure applied to the first and second plates, and the like.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, preferred embodiments of the present invention will be described with reference to the accompanying drawings.

Figure 1:
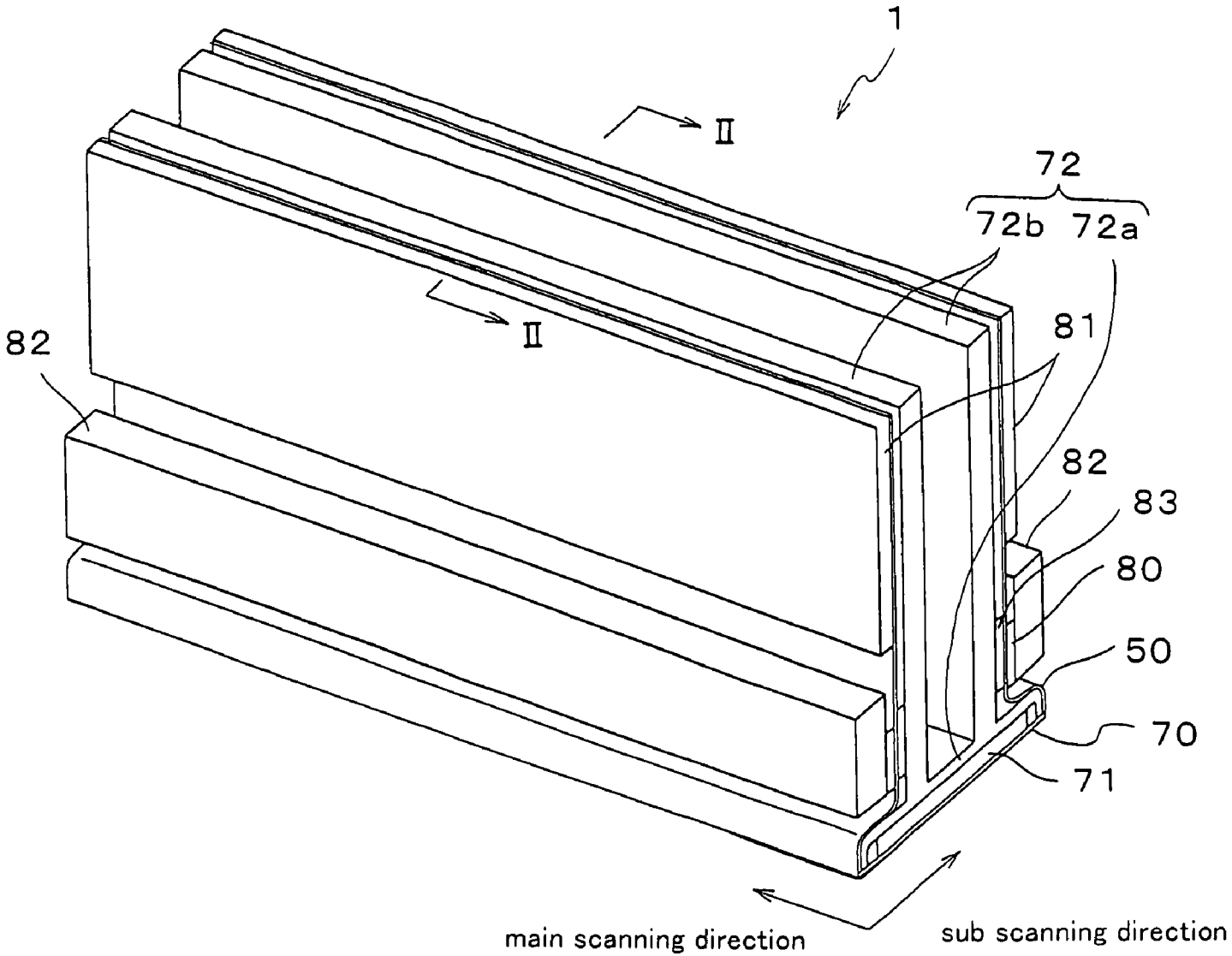
FIG. 1 is a perspective view of an ink-jet head that is manufactured by a method according to a first embodiment of the present invention.
Figure 2:
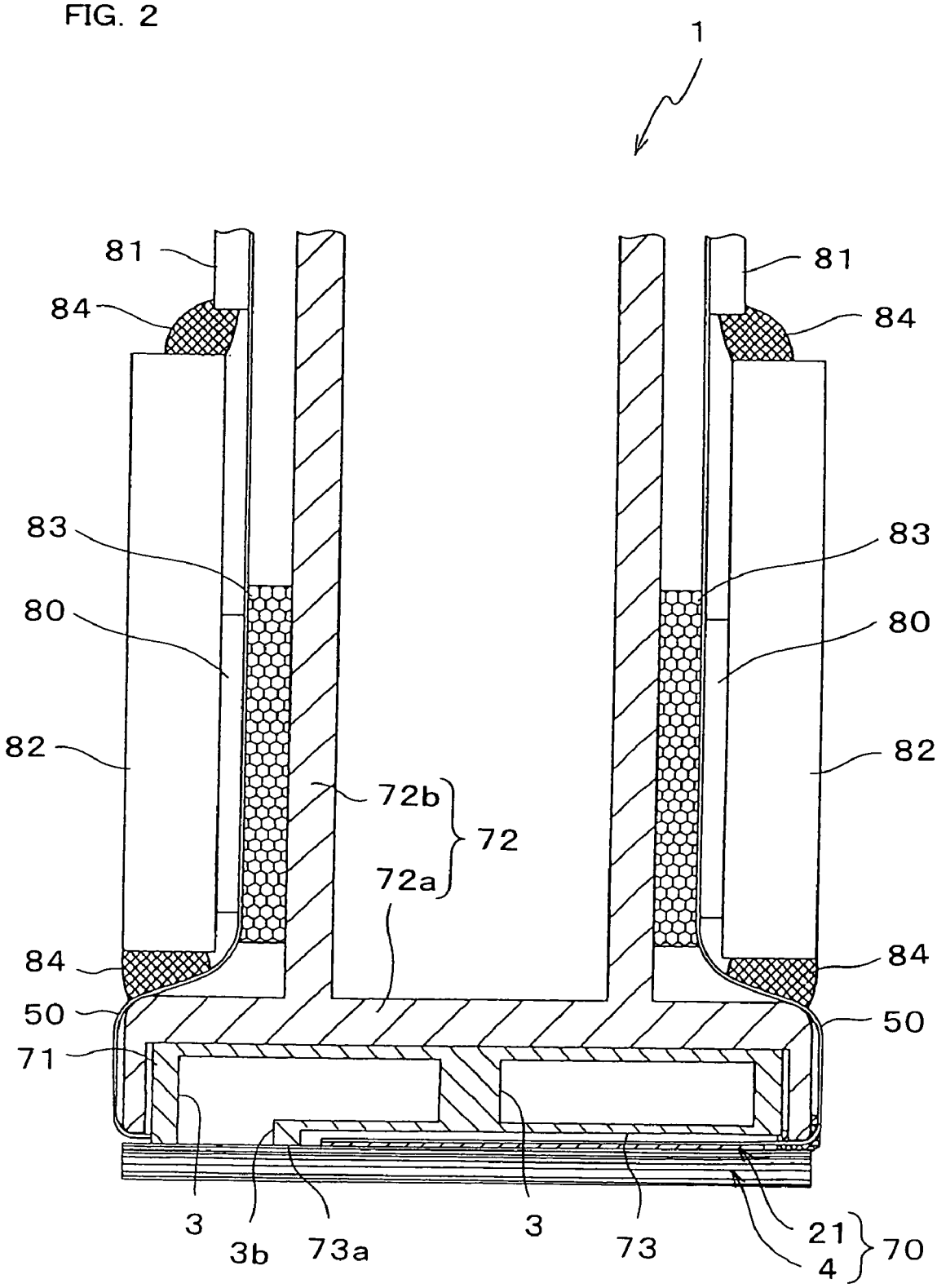
FIG. 2 shows a section taken along a line II-II of FIG. 1.

First, with reference to FIGS. 1 and 2, a description will be given to an ink-jet head 1 that is manufactured by a method according to a first embodiment of the present invention. The ink-jet head 1 includes a head main body 70 and a base block 71. The head main body 70 has, in a plan view, a rectangular shape extending in main scanning direction, and ejects an ink droplet to a paper. The base block 71 is disposed above the head main body 70 and formed therein with two ink reservoirs 3 serving as passages for ink that will be supplied to the head main body.

The head main body 70 includes a passage unit 4 in which ink passages are formed, and a plurality of actuator units 21 that are bonded to an upper face of the passage unit 4. A flexible printed circuit (FPC) 50 as a power supply member is bonded on an upper face of the actuator unit 21. As illustrated in FIG. 2, the FPC 50 extends out to left and right of the base block 71. The base block 71 is made of a metallic material such as stainless steel. The ink reservoir 3 in the base block 71 is a substantially rectangular parallelepiped hollow region that is formed along a longitudinal direction of the base block 71.

A portion of a lower face 73 of the base block 71 in the vicinity of each opening 3*b* protrudes downward from its surrounding portion. The base block 71 is, at the portion 73*a* of its lower face 73 in the vicinity of each opening 3*b*, in contact with the passage unit 4. Thus, a region of the lower face 73 of the base block 71, other than the portion 73*a* in the vicinity of each opening 3*b*, stays apart from the passage unit 4, thereby forming a space for the actuator units 21.

The base block 71 is bonded to and fixed within a concavity that is formed in a lower face of a holding portion 72*a* of a holder 72. The holder 72 includes a holding portion 72*a* and a pair of plate-like protruding portions 72*b*. The pair of protruding portions 72*b* locate at a predetermined interval therebetween, and extend from an upper face of the holding portion 72*a* in a direction perpendicular thereto. The FPC 50 bonded to the actuator unit 21 is disposed such that it extends along a surface of the protruding portion 72*b* of the holder 72 with an elastic member 83 such as sponge being interposed between them. A driver IC 80 is mounted on the FPC 50 that is disposed along the surface of the protruding portion 72*b* of the holder 72. The FPC 50 is electrically connected with the driver IC 80 and the actuator unit 21, in order to transmit to the actuator unit 21 a driving signal outputted from the driver IC 80.

A heat sink 82 of substantially rectangular parallelepiped shape is disposed in close contact with an outer side face of the driver IC 80. A substrate 81 is disposed on the outside of the FPC 50 above the driver IC 80 and the heat sink 82. An upper face of the heat sink 82 is bonded to the substrate 81 with a seal member 84. A lower face of the heat sink 82 is also bonded to the FPC 50 with a seal member 84.

Figure 3:
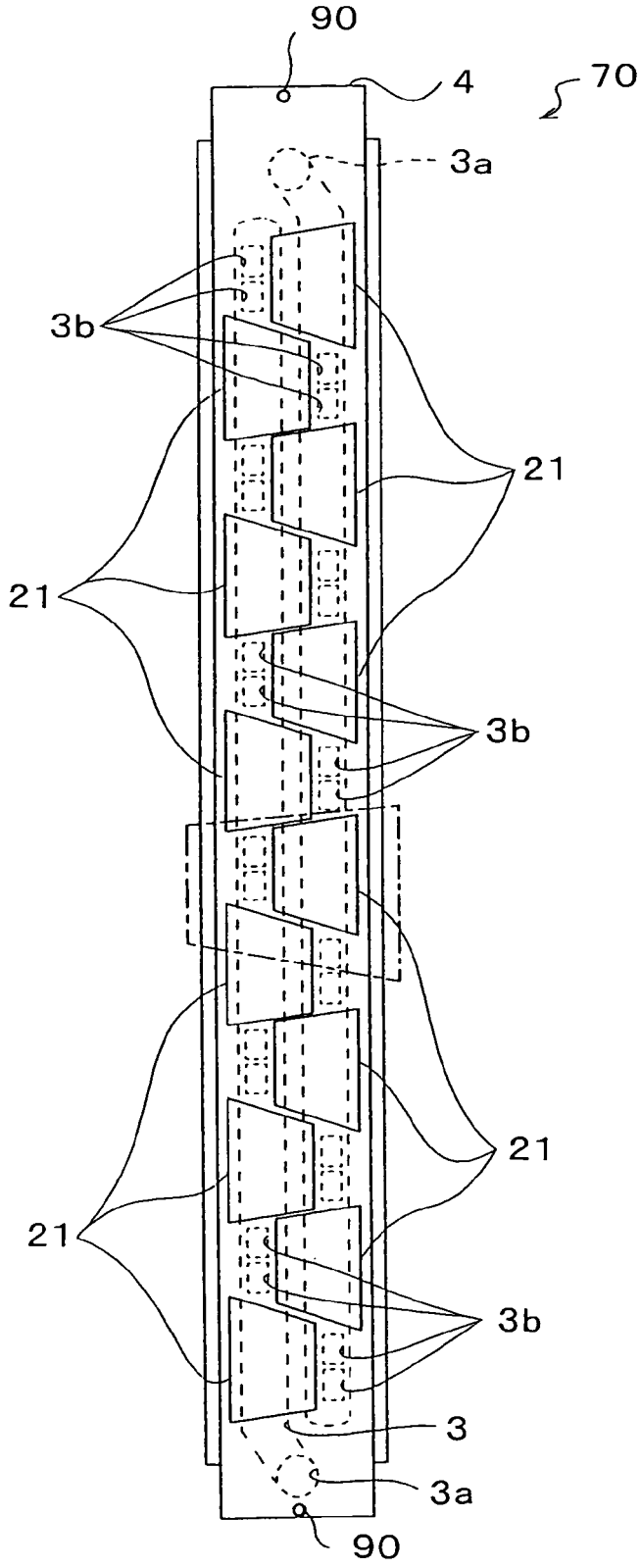
FIG. 3 is a top view of a head main body that is included in the ink-jet head of FIG. 2.

In FIG. 3, the ink reservoirs 3 which are actually formed within the base block 71 are illustrated with conceptional broken lines. The two ink reservoirs 3 are formed in parallel at a predetermined interval therebetween, and in such a condition extend along a longitudinal direction of the head main body 70. Each of the two ink reservoirs 3 has, at its one end, an opening 3*a* through which the ink reservoir 3 communicates with an ink tank (not illustrated) so that it is always filled up with ink. Each ink reservoir 3 has many openings 3*b* formed along the longitudinal direction of the head main body 70. As described above, the ink reservoir 3 and the passage unit 4 are connected with each other through the openings 3*b*. The many openings 3*b* are paired, and arranged adjacent on a pair basis along the longitudinal direction of the head main body 70. Pairs of openings 3*b* communicating with one ink reservoir 3 and pairs of openings 3*b* communicating with the other ink reservoir 3 are arranged in a zigzag pattern. The passage unit 4 has, at its longitudinal ends, positioning holes 90 formed therethrough. The positioning holes 90 are provided in the middle of the width of the passage unit 4. The positioning holes 90 are used during a manufacturing process of the ink-jet head 1, as will be detailed later.

In a region where no opening 3*b* is provided, the actuator units 21 each having a trapezoidal shape in a plan view are arranged in a zigzag pattern which is inverse to the arrangement pattern of the openings 3*b*. Parallel opposed sides (which mean upper and lower sides) of each actuator unit 21 are parallel to the longitudinal direction of the passage unit 4. Oblique sides of neighboring actuator units 21 partially overlap with respect to a widthwise direction of the passage unit 4.

Figure 4:
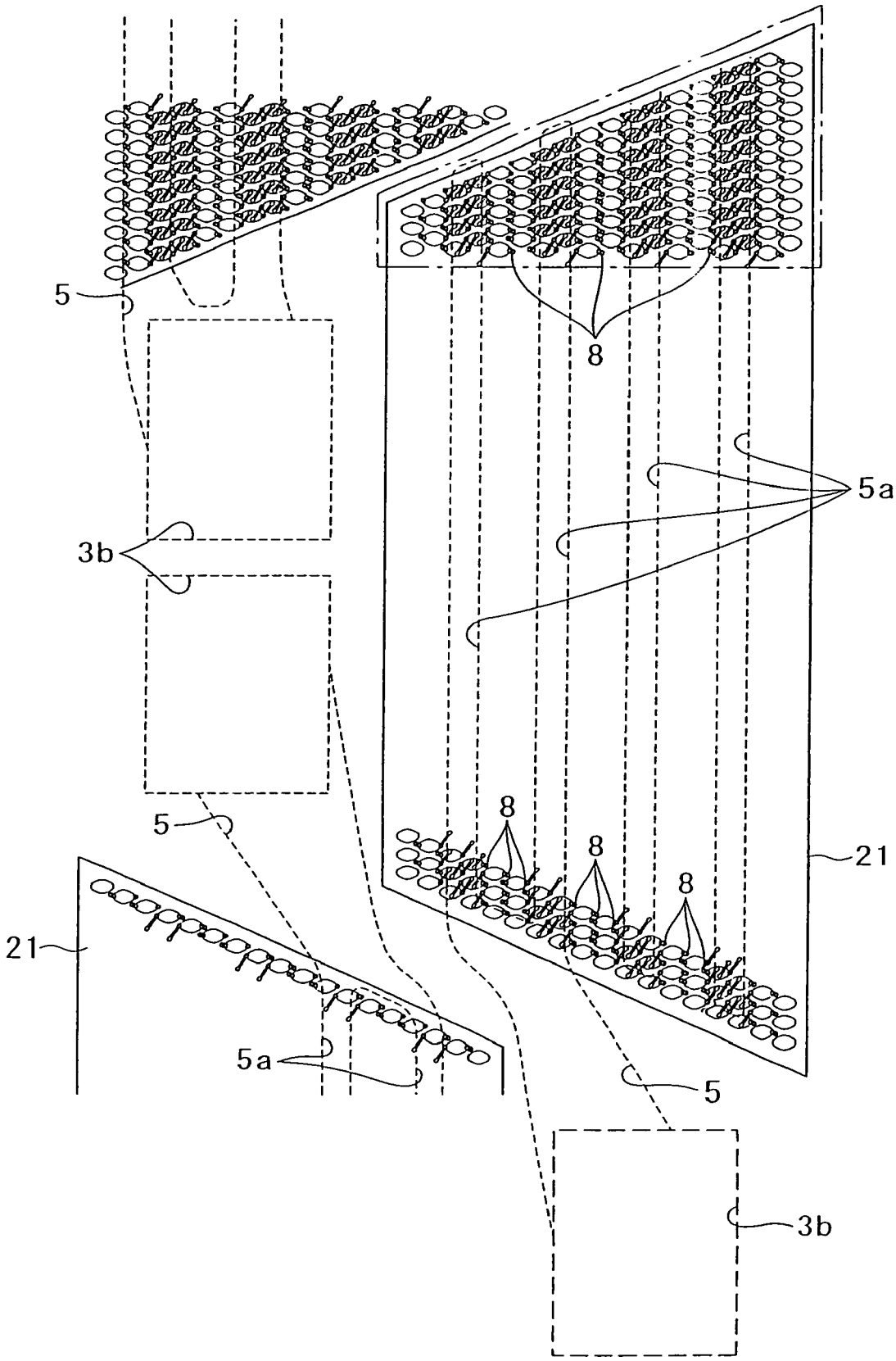
FIG. 4 is an enlarged view of a region that is enclosed with an alternate long and short dash line in FIG. 3.

As illustrated in FIG. 4, the opening 3*b* provided in the ink reservoir 3 communicates with a manifold channel 5 as a common ink chamber, and an end portion of the manifold channel 5 branches into two sub-manifold channels 5*a*. In a plan view, two sub-manifold channels 5*a*, which branch from an adjacent opening 3*b*, extends from each oblique side of the actuator unit 21. That is, below an actuator unit 21, a total of four sub-manifold channels 5*a*, which are spaced apart from one another, extend along the parallel opposed sides of the actuator unit 21.

A lower face of the passage unit 4 is an ink ejection face, and its regions corresponding in a plan view to areas where the actuator units 21 are bonded form ink ejection regions. In the ink ejection region, many openings which serve as nozzle holes 8 are arranged in a matrix. The openings which serve as nozzle holes 8, only a part of which are illustrated in FIG. 4 for the purpose of simplification, are actually arranged throughout a whole of the ink ejection region.

Figure 5:
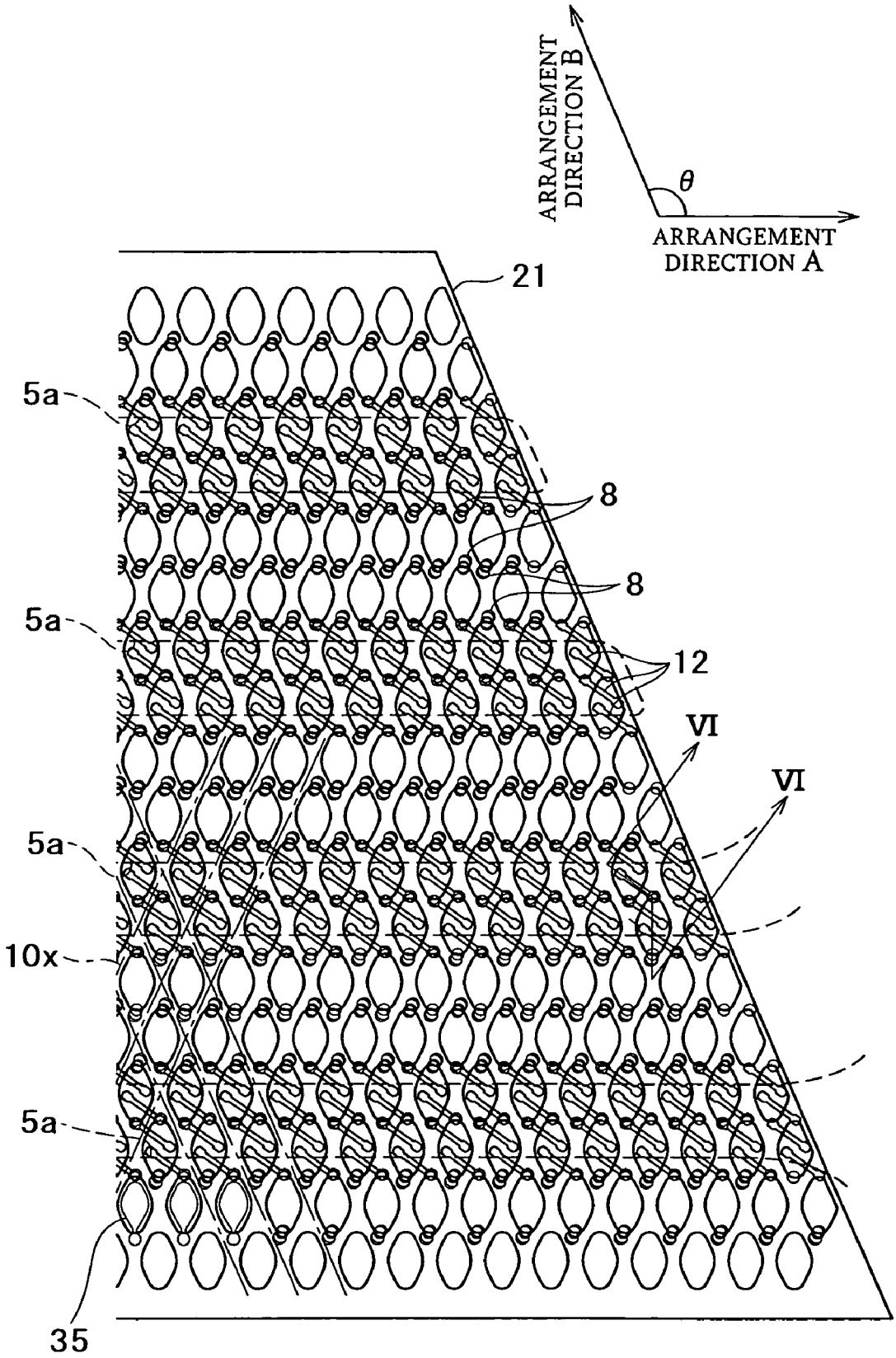
FIG. 5 is an enlarged view of a region that is enclosed with an alternate long and short dash line in FIG. 4.

FIGS. 4 and 5 illustrate a plane of the passage unit 4 where many pressure chambers 10 are arranged in a matrix, as viewed perpendicularly to the ink ejection face. In a plan view, each pressure chamber 10 has a substantially rhombic shape with its corners rounded. A longer diagonal of the pressure chamber 10 is parallel to the widthwise direction of the passage unit 4. Each pressure chamber 10 has its one end communicating with a nozzle hole 8 and the other end communicating through an aperture 12 (see FIG. 6A) with a sub-manifold channel 5*a* which serves as a common ink passage. On the actuator unit 21, an individual electrode 35, whose planar shape is similar to but somewhat smaller than that of the pressure chamber 10, is provided at a position overlapping each pressure chamber in a plan view. FIG. 5 illustrates only a part of many individual electrodes for the purpose of simplification. In addition, FIGS. 4 and 5 illustrate the pressure chambers 10, the apertures 12, etc., with solid lines, although they are provided within the actuator unit 21 or the passage unit 4 and therefore should actually be illustrated with broken lines.

Referring to FIG. 5, conceptional rhombic regions 10*x* each containing a pressure chamber 10 are arranged adjacent to one another in a matrix in two directions, i.e., in arrangement directions A and B, so as not to overlap but share their sides with one another. The arrangement direction A is parallel to the longitudinal direction of the ink-jet head 1, i.e., to an extension direction of the sub-manifold channels 5*a* or to a shorter diagonal of the rhombic region 10*x*. The arrangement direction B forms an obtuse angle θ with the arrangement direction A, and is parallel to one side of the rhombic region 10*x*. A pressure chamber 10 and its corresponding rhombic region 10 have the same center, and their contours are apart from each other in a plan view.

Figure 6A:
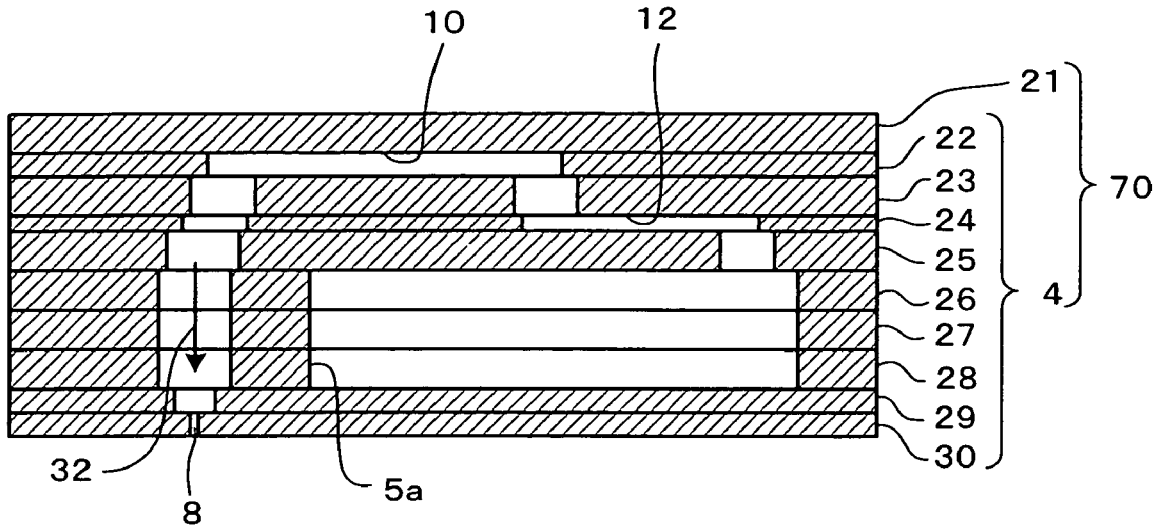
FIG. 6A shows a section of the head main body taken along a line VI-VI of FIG. 5.

As illustrated in FIG. 6A, the nozzle hole 8 communicates, through the pressure chamber 10 and the aperture 12, to the sub-manifold channel 5*a*. Formed within the passage unit 4 are individual ink passages 32 each of which corresponds to each pressure chamber 10 and extends from an outlet of a sub-manifold channel 5*a* through an aperture 12 and a pressure chamber 10 to a nozzle hole 8.

Figure 7:
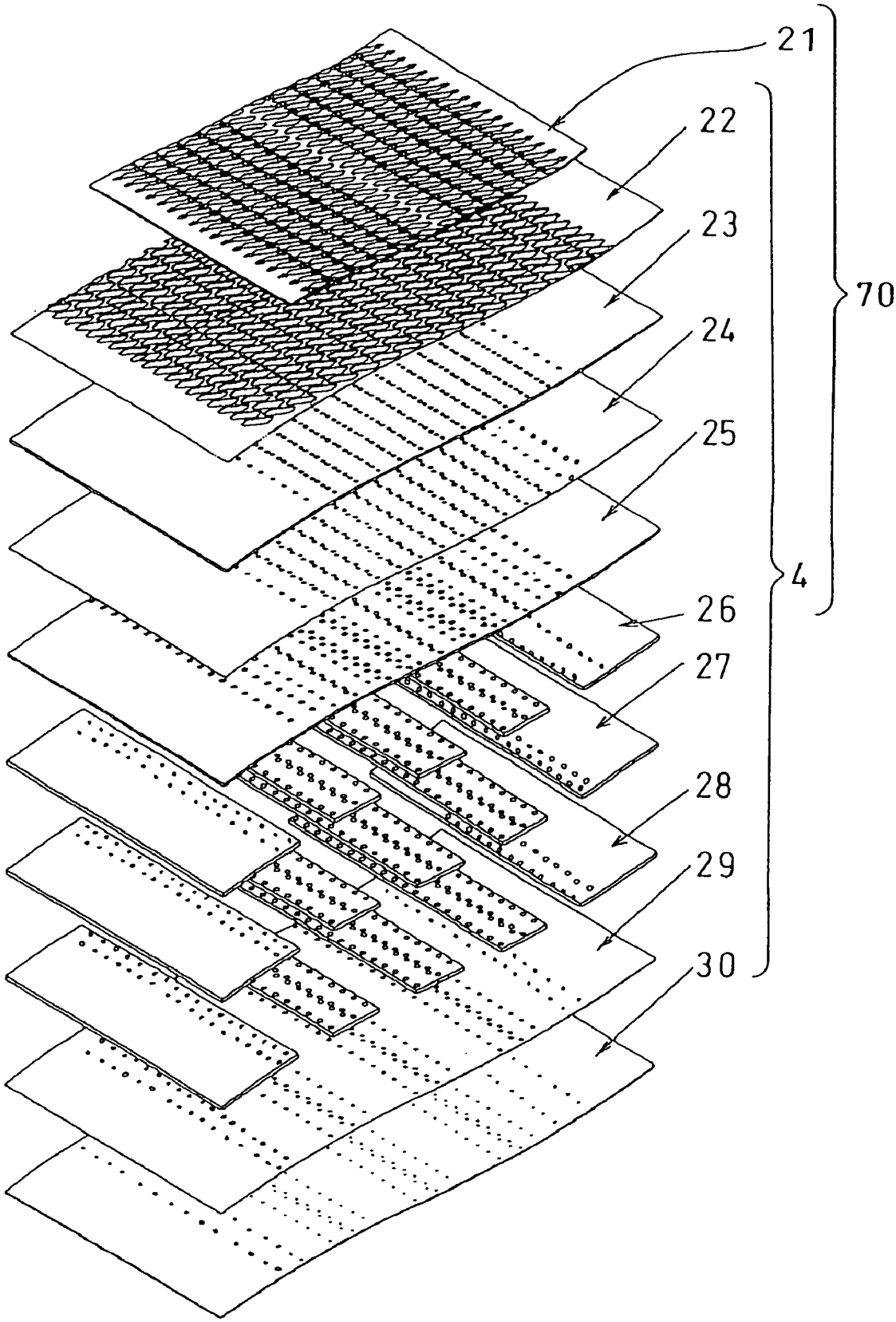
FIG. 7 is a partial exploded perspective view of the head main body shown in FIG. 6A.

As illustrated in FIGS. 6A and 7, the passage unit 4 has a layered structure of a total of nine metal plates, i.e., from the top, a cavity plate 22, a base plate 23, an aperture plate 24, a supply plate 25, manifold plates 26, 27, 28, a cover plate 29, and a nozzle plate 30.

The cavity plate 22 is a metal plate in which formed are many substantially rhombic openings that serve as pressure chambers 10. The base plate 23 is a metal plate in which formed are many communication holes each connecting each pressure chamber 10 and a corresponding aperture 12 and many communication holes each connecting each pressure chamber 10 and a corresponding nozzle hole 8. The aperture plate 24 is a metal plate in which formed are, in addition to holes that serve as apertures 12, many communication holes each connecting each pressure chamber 10 and a corresponding nozzle hole 8. The supply plate 25 is a metal plate in which formed are many communication holes each connecting each aperture 12 and a sub-manifold channel 5*a* and many communication holes each connecting each pressure chamber 10 and a corresponding nozzle hole 8. Each of the manifold plates 26, 27, and 28 is a metal plate in which formed are, in addition to holes that constitutes sub-manifold channels 5*a*, many communication holes each connecting each pressure chamber 10 and a corresponding nozzle hole 8. The cover plate 29 is a metal plate in which formed are many communication holes each connecting each pressure chamber 10 and a corresponding nozzle hole 8. The nozzle plate 30 is a metal plate in which formed are many nozzle holes 8. Further, each of the nine metal plates has, at its both longitudinal ends, through holes which constitute the positioning holes 90 extending through the passage unit 4. These nine metal plates are positioned to one another and put in layers such that the individual ink passages 32, one of which is illustrated in FIG. 6A, are formed therein. Here, each of the communication holes and the nozzle holes 8 has a circular shape in a section along a plane parallel to a plate where the hole is formed.

Figure 6B:
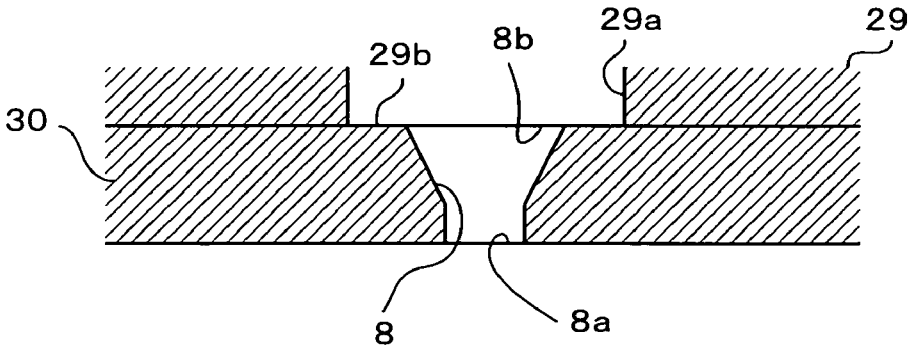
FIG. 6B is an enlarged view around a nozzle hole shown in FIG. 6A.

As illustrated in FIG. 6B, a hole extending through the nozzle plate 30 defines the nozzle hole 8. An inside wall defining the nozzle hole 8 has a tapered shape such that an opening 8*a* of the nozzle hole 8 in the ink ejection face has a diameter smaller than a diameter of an opening 8*b* of the nozzle hole 8 facing the cover plate 29. The diameter of the opening 8*b* of the nozzle hole 8 is smaller than a diameter of an opening 29*b*, which faces the nozzle plate 30, of the communication hole 29*a* formed in the cover plate 29. Accordingly, an overhang is formed around the opening 8*b* of the nozzle plate 30 which faces the communication hole 29*a*.

Next, the actuator unit 21 will be described with reference to FIGS. 8A and 8B.

Figure 8A:
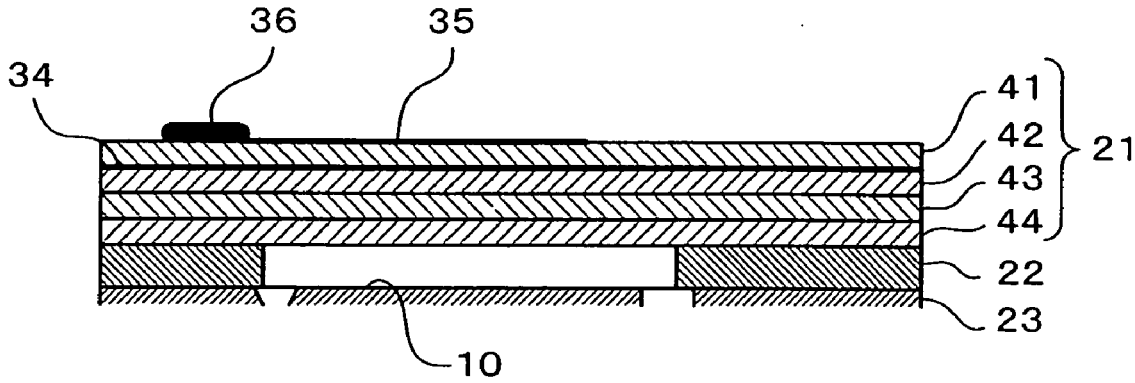
FIG. 8A is an enlarged view of an actuator unit shown in FIG. 6A.

As illustrated in FIG. 8A, the actuator unit 21 includes four piezoelectric sheets 41, 42, 43, and 44 having the same thickness of approximately 15 μm and made of a lead zirconate titanate (PZT)-base ceramic material, which has ferroelectricity. The piezoelectric sheets 41, 42, 43, and 44 which are put in layers are disposed so as to extend many pressure chambers 10 included in one ink ejection region of the passage unit 4.

Individual electrodes 35 are provided on the uppermost piezoelectric sheet 41. A common electrode 34 having a thickness of approximately 2 μm is interposed between the uppermost piezoelectric sheet 41 and the piezoelectric sheet 42 put thereunder. The common electrode 34 covers an entire surface of the sheet. No electrode is provided between the piezoelectric sheet 42 and the piezoelectric sheet 43. Both the individual electrodes 35 and the common electrode 34 are made of a metallic material such as an Ag—Pd-base one.

Figure 8B:
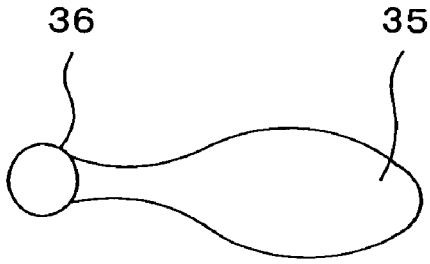
FIG. 8B is a top view showing an individual electrode that is formed on a surface of the actuator unit shown in FIG. 8A.

The individual electrode has a thickness of approximately 1 μm and, as illustrated in FIG. 8B, has a substantially rhombic shape in a plan view which is similar to the shape of the pressure chamber 10 illustrated in FIG. 5. One acute portion of the substantially rhombic individual electrode 35 extends out and has, at its end portion, a circular land 36 having a diameter of approximately 160 μm. The land 36 is electrically connected to the individual electrode 35. The land 36 is made of, e.g., gold that includes grass frits, and bonded to a surface of the extending-out portion of the individual electrode 35 as illustrated in FIG. 8A.

The common electrode 34 is grounded in a not-illustrated region. Thus, the common electrode 34 is, in every region thereof corresponding to a pressure chamber 10, equally kept at the ground potential. An individual electrode 35 is electrically connected to the driver IC 80 via a land 36 and the FPC 50 which includes lead wires each corresponding to each individual electrode 35, so that potentials of the individual electrodes 35 corresponding to the respective pressure chambers 10 can be controlled independently of one another (see FIGS. 1 and 2).

Next, driving methods of the actuator unit 21 will be described. In the actuator unit 21, the piezoelectric sheet 41 is polarized in its thickness direction. Thus, the actuator unit 21 has a so-called unimorph structure in which the uppermost piezoelectric sheet 41 forms a layer that includes an active part while the lower three piezoelectric sheets 42 to 44 form inactive layers. Therefore, when an individual electrode 35 is set at a positive or negative predetermined potential in a state where, for example, an electric field and polarization occur in the same direction, portions of the piezoelectric sheet 41 sandwiched between electrodes are applied with the electric field and act as active parts which contract in a direction perpendicular to the polarization by a transversal piezoelectric effect. On the other hand, the piezoelectric sheets 42 to 44 are not affected by the electric field, and therefore do not contract by themselves. As a result, the upper piezoelectric sheet 41 and the lower piezoelectric sheets 42 to 44 exhibit unequal distortion in the direction perpendicular to the polarization, so that the piezoelectric sheet 41 to 44 as a whole deform into a convex shape toward the inactive side (which means a unimorph deformation). At this time, the piezoelectric sheets 41 to 44 deform into a convex shape toward the pressure chamber side, because a bottom face of the piezoelectric sheet 44 is secured to an upper face of the cavity plate 22 which defines the pressure chambers 10 as illustrated in FIG. 8A. Consequently, the volume of the pressure chamber 10 is reduced, so that ink contained in the pressure chamber 10 receives increased pressure and therefore is ejected through a corresponding nozzle hole 8. Then, when the individual electrode 35 is reset at the same potential as that of the common electrode 34, the piezoelectric sheets 41 to 44 restore their original shape and the pressure chamber 10 restores its original volume. Ink is thereby supplied from the manifold channel 5 into the pressure chamber 10.

Next, a manufacturing method of the ink-jet head 1 will be described. The passage unit 4 is formed through the step of bonding nine metal plates, i.e., the cavity plate 22, the base plate 23, the aperture plate 24, the supply plate 25, the manifold plate 26, 27, 28, the cover plate 29, and the nozzle plate 30.

In the step of bonding, the metal plates 22 to 30 are put in layers with an adhesive and then bonded under pressure. The step of bonding includes the steps of laminating, preparing for pressure application, and applying pressure. The respective steps will then be described in sequence.

Figure 9:
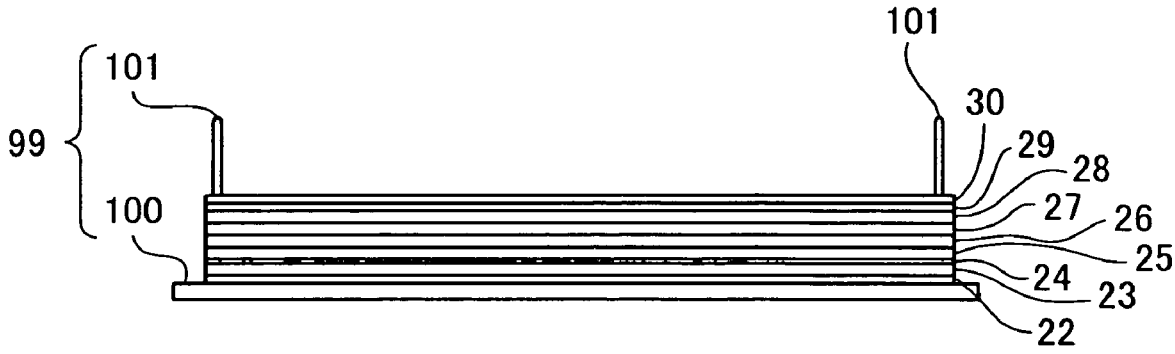
FIG. 9 is an explanatory view showing the step of laminating which is adopted for forming a passage unit shown in FIG. 6A.

The step of laminating will be described with reference to FIGS. 9 and 10. In the step of laminating, the nine metal plates 22 to 30 are positioned to one another into layers such that the individual ink passages 32 (see FIG. 6A) are formed therein. In this step, a lamination jig as illustrated in FIG. 9 is used. The lamination jig 99 includes a plate-like base 100 and two positioning pins 101. The base 100 is elongated in the same direction as the elongation direction of the metal plates 22 to 30. At both ends of the base 100 in its longitudinal direction, the respective positioning pins 101 stand in the middle of the width of the base 100. The positioning pins 101 protrude therefrom in a direction perpendicular to the plane of the base. The positioning pins 101, which are used for positioning the metal plates in this step, are disposed at positions corresponding to the positioning holes 90 (see FIG. 3) that extend through the metal plates of the passage unit 4. In the step of laminating, the positioning pins 101 are inserted sequentially into the positioning holes 90 of the cavity plate 22, the base plate 23, the aperture plate 24, the supply plate 25, the manifold plates 26, 27, 28, the cover plate 29, and the nozzle plate 30, which are thereby put in layers with an adhesive. The nozzle plate 30, which is the last one laminated on the base 100, is placed on the top.

Figure 10:
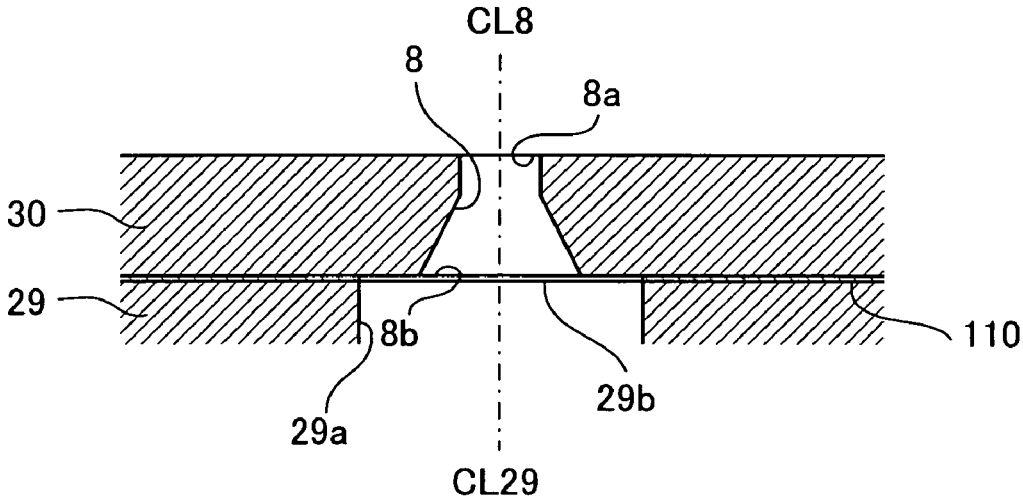
FIG. 10 is an enlarged sectional view around the nozzle hole during the step of laminating shown in FIG. 9.

On an interface between the nozzle plate 30 and the cover plate 29, as illustrated in FIG. 10, the opening 8*b* of the nozzle hole 8 is included within the opening 29*b* of the communication hole 29*a*, i.e., the opening 8*b* is positioned inside of the opening 29*b*. In addition, a centerline CL8 of the nozzle hole 8 is aligned with a centerline CL29 of the communication hole 29*a*. An adhesive 110 exists between the nozzle plate 30 and the cover plate 29.

Figure 11:
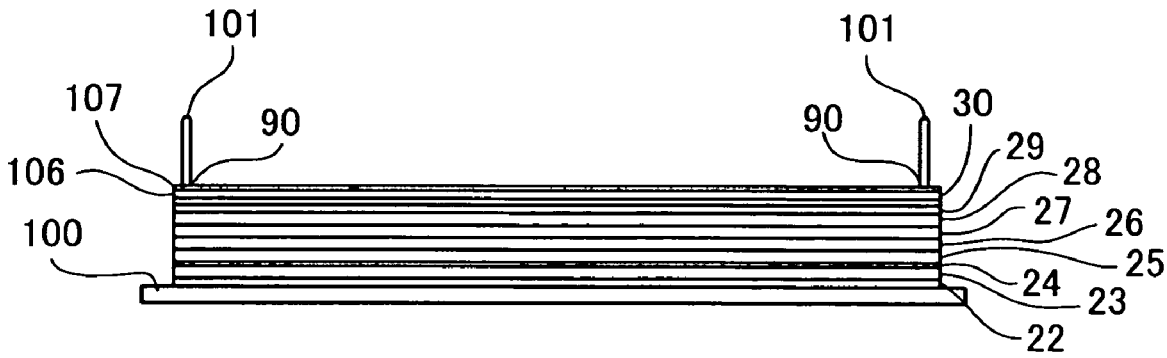
FIG. 11 is an explanatory view showing the step of preparing for pressure application which is adopted for forming the passage unit shown in FIG. 6A.

Next, the step of preparing for pressure application, which follows the step of lamination, will be described with reference to FIGS. 11, 12, and 13. In the step of preparing for pressure application, a pressure plate 106 and a resin sheet 107 are sequentially put on the ink ejection face of the nozzle plate 30.

The pressure plate 106 has many relief holes 106*a*. The pressure plate 106 has the same shape as that of the cover plate 29, and size, shape, and position of the relief hole 106*a* of the pressure plate 106 are the same as those of the communication hole of the cover plate 29. The pressure plate 106 also has, at its longitudinal ends, positioning holes 90 formed in the middle of the width of the pressure plate 106, as is the same as the cover plate 29. The pressure plate 106 is put on the nozzle plate 30 such that the relief holes 106*a* correspond to the respective nozzle holes 8 of the nozzle plate 30, i.e., centerlines CL106 of the relief holes 106*a* align with the respective centerlines CL8 of the nozzle holes 8, while the positioning pins 101 of the lamination jig 99 are inserted into the positioning holes 90.

The resin sheet 107 is made of, e.g., a NAFLON sheet, etc. The resin sheet 107 protects the pressure plate 106 and at the same time uniformalizes pressure which is applied to the pressure plate 106. A surface of the resin sheet 107 has been given a liquid repellent treatment. The resin sheet 107 and the pressure plate 106 may either be separate members or be integrated into a single member.

Figure 12:
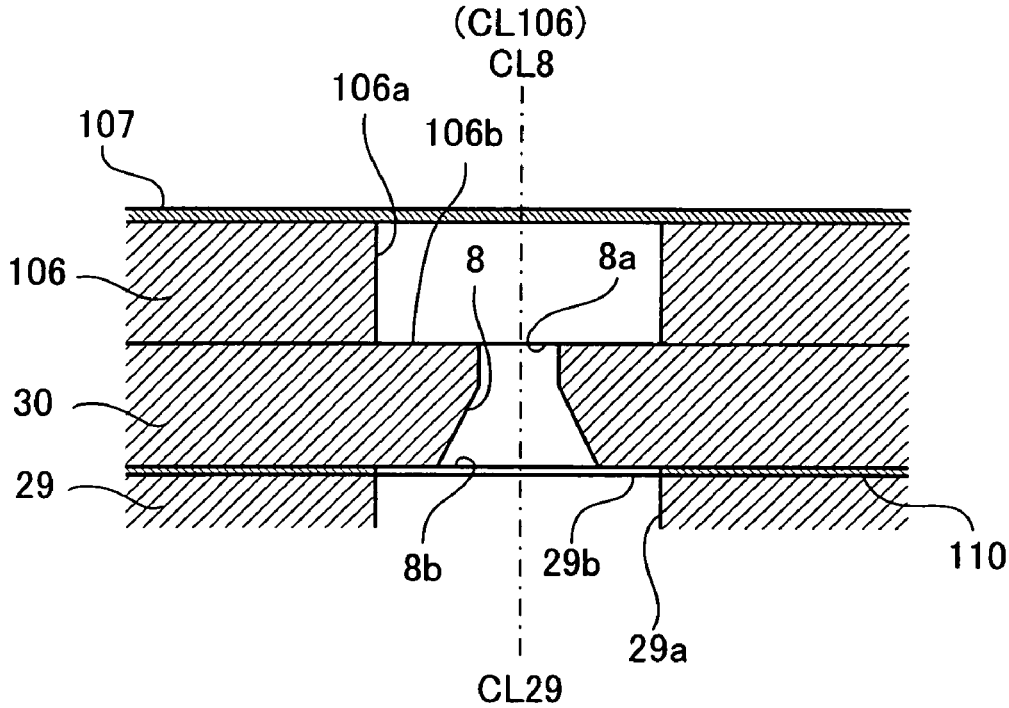
FIG. 12 is an enlarged sectional view around the nozzle hole during the step of preparing for pressure application shown in FIG. 11.

In the step of preparing for pressure application, as illustrated in FIG. 12, the pressure plate 106 is placed on the nozzle plate 30 such that the nozzle plate 30 is sandwiched between the cover plate 29 and the pressure plate 106 with the centerline CL106 of the relief hole 106*a* aligning with the centerline CL8 of the nozzle hole 8. Here referring to FIG. 13, in a plane along the ink ejection face of the nozzle plate 30, an opening 106*b* of the relief hole 106*a* of the pressure plate 106 facing the nozzle plate 30 has its outer edge located on a line of intersection of the interface between the nozzle plate 30 and the cover plate 29 and a sidewall of the communication hole 29*a*, i.e., on a circle defining the opening 29*b*. In addition, the outer edge of the opening 106*b* is located inside of a hypothetical circle 120 which is concentric with the opening 8*b* of the nozzle hole 8 and has a radius of 1.5 times larger than the distance from the center to the line of intersection of the interface and the sidewall of the communication hole 29*a*, i.e., than the distance from the center of the opening 8*b* of the nozzle hole 8 to the outer edge of the opening 29*b* of the communication hole 29*a*.

Next, the step of applying pressure, which follows the step of preparing for pressure application, will be described with reference to FIGS. 14 and 15. Arrows illustrated in FIGS. 14 and 15 show a direction of pressure application.

Figure 14:
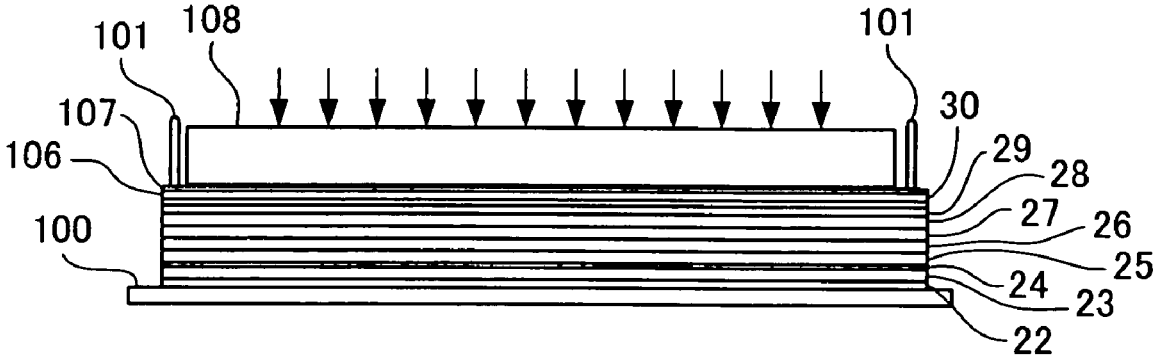
FIG. 14 is an explanatory view showing the step of applying pressure which is adopted for forming the passage unit shown in FIG. 6A.

In the step of applying pressure, as illustrated in FIG. 14, a pressure jig 108 is placed on the resin sheet 107 that has been laminated in the step of preparing for pressure application. The pressure jig 108 is placed with its lower flat face as a pressure application face being in contact with the resin sheet 107. The pressure jig 108 applies pressure to the metal plates when driven by a driver (not illustrated).

Figure 15:
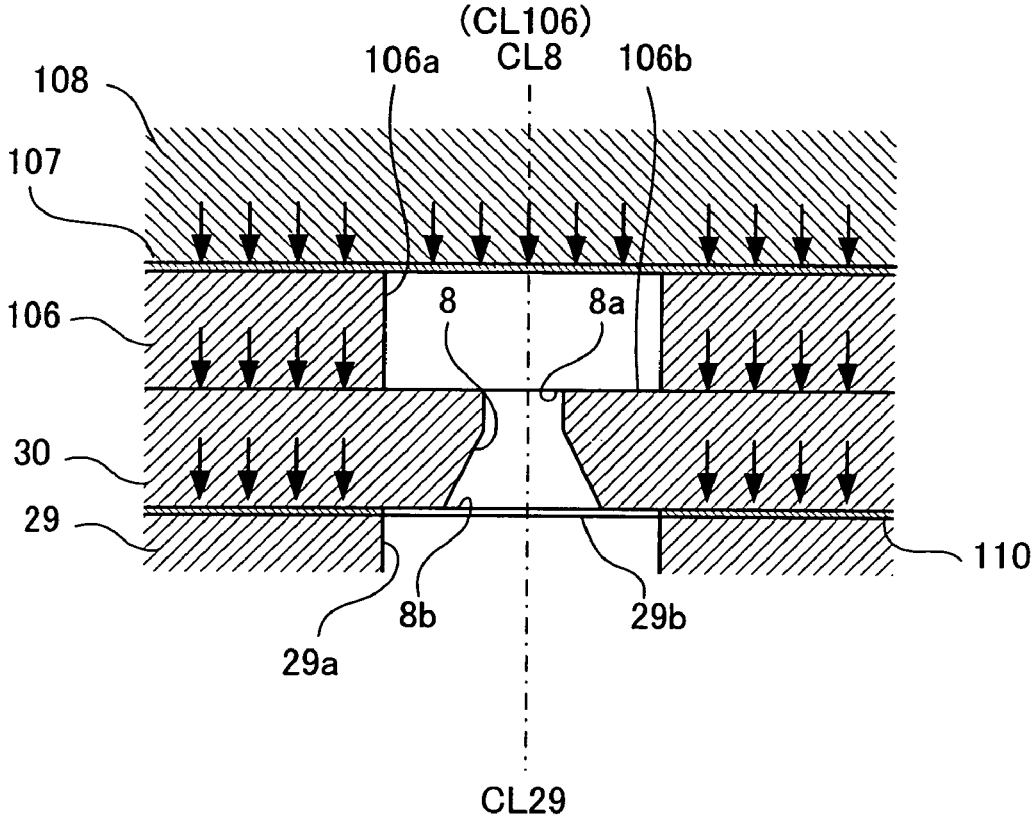
FIG. 15 is an enlarged sectional view around the nozzle hole during the step of applying pressure shown in FIG. 14.

When the pressure jig 108 is driven as shown in FIG. 15, pressure applied is uniformalized over a plane by means of the resin sheet 107 and the uniform pressure is transmitted to the pressure plate 106. The pressure transmitted to the pressure plate 106 is then transmitted to the ink ejection face of the nozzle plate 30. The overhangs of the nozzle plate 30 formed around the communication holes 29*a* do not receive the pressure, because the pressure is not applied to portions of the nozzle plate 30 corresponding to the relief holes 106*a* of the pressure plate 106.

Figure 13:
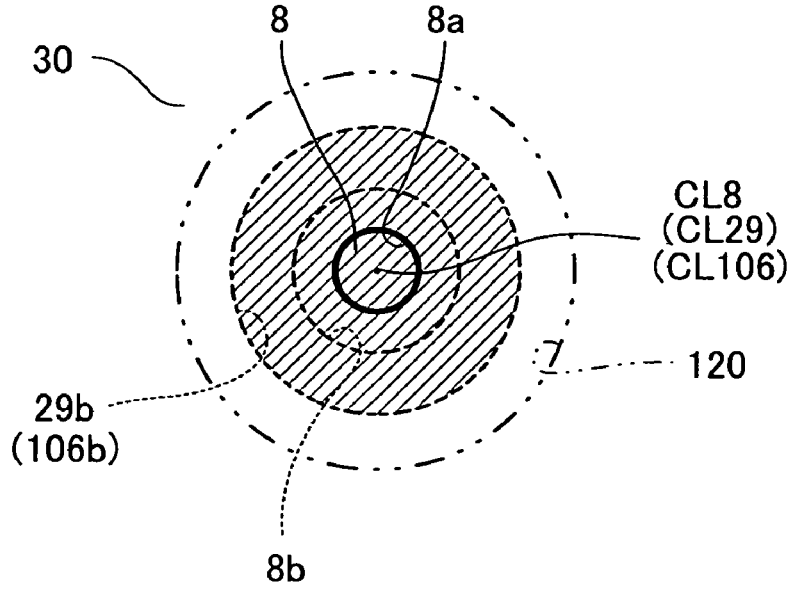
FIG. 13 is a top view of the nozzle hole during the step of preparing for pressure application shown in FIG. 11, as seen from a side of an ink ejection face.

This means that, referring to FIG. 13, a whole region (as hatched in FIG. 13) inside the opening 29*b* of the communication hole 29*a* does not receive pressure during the step of applying pressure, while an annular region sandwiched between the hypothetical circle 120 and the circle defining the opening 29*b* receives pressure. The metal plates under such pressure are subjected to a heat treatment, through which the adhesive is cured to bond the metal plates.

Through these steps, the step of bonding is finished. The actuator units 21 formed through a separate step is assembled to the passage unit 4, and thus the ink-jet head 1 is obtained.

As thus far described above, in the manufacturing method according to the first embodiment of the present invention, the overhangs of the nozzle plate 30 formed around the communication holes 29*a* do not receive pressure during the step of applying pressure (see FIG. 15). Accordingly, the adhesive 110 existing between the nozzle plate 30 and the cover plate 29 can be prevented from bulging into the communication holes 29*a* and flowing into the nozzle hole 8. This can prevent the adhesive 110 from blocking the nozzle holes 8 or causing ink ejection troubles without any tight control over conditions such as a kind of adhesive, the amount of adhesive, a temperature in adhesion, pressure applied to the nozzle plate 30 and the cover plate 29, and the like. Moreover, the ink-jet head 1 can be manufactured at a reduced cost.

Since pressure is applied to the annular region which is defined as a region sandwiched between the hypothetical circle 120 (see FIG. 13) and the circle defining the opening 29*b* of the communication hole 29*a*, a thickness of the adhesive 110 in the annular region is leveled. Thereby, the nozzle plate 30 and the cover plate 29 are reliably bonded to each other, so that ink can smoothly be ejected through the nozzle holes 8 and moreover the manufacture yield of the ink-jet head 1 can be increased.

Further, the region inside the annular region (i.e., the hatched region in FIG. 13) is designed to receive no pressure throughout its whole region. Therefore, the relief holes 106*a* can easily processed.

In the step of laminating, the nozzle plate 30 and the cover plate 29 are laminated in such a manner that the centerline CL8 of the nozzle hole 8 and the centerline CL29 of the communication hole 29*a* align with each other. Due to this it becomes easier to properly adjust the conditions such as a kind of adhesive, the amount of adhesive, a temperature in adhesion, pressure applied to the nozzle plate 30 and the cover plate 29, and the like.

The step of applying pressure is preceded by the step of preparing for pressure application in which the pressure plate having many relief holes 106*a* is put on the nozzle plate 30. If some different types of pressure plate, which are different in diameter and arrangement of relief holes, have been prepared, it becomes unnecessary to replace the pressure jig 108 in order to form different types of passage unit 4 which are different in diameter and arrangement of the nozzle holes 8.

Since the resin sheet 107 uniformalizes pressure which has been applied from the pressure jig 108 and then transmits the pressure to the pressure plate 106, deformation of the pressure plate 106 can be prevented, thus carrying out proper pressure application. Also prevented is adhesion of the pressure plate 106 and the pressure jig 108 to each other, which may otherwise be caused by bulged adhesive 110 interacting with vapor that includes volatile matter emitted upon the heat treatment for curing the adhesive 110.

The liquid repellent treatment given to the surface of the resin sheet 107 enhances the prevention of adhering of an extra adhesive to the pressure plate 106.

The pressure plate 106 has the same shape as that of the cover plate 29, and moreover the hole formed in the pressure plate 106 has the same size, shape and position as those of the hole formed in the cover plate 29. That is, the pressure plate 106 and the cover plate 29 are equalized, and therefore they can be prepared through the same process. This can reduce a manufacture cost of the pressure plate 106.

Next, with reference to FIGS. 16, 17, and 18, a description will be given to a manufacturing method of an ink-jet head according to a second embodiment of the present invention. An ink-jet head manufactured through the method of this embodiment is substantially the same as the head 1 manufactured through the method of the first embodiment. Thus, substantially the same members as those of the first embodiment will be denoted by the common reference numerals without a specific description thereof.

A passage unit 4 of an ink-jet head 1 is formed through a step of bonding nine metal plates 22 to 30. In the step of bonding, the metal plates 22 to 30 are put in layers with an adhesive and then bonded under pressure. This step includes the steps of laminating and applying pressure, without the step of preparing for pressure application, which is employed in the first embodiment. The step of laminating is the same as that of the first embodiment. The step of applying pressure will be described below.

Figure 16:
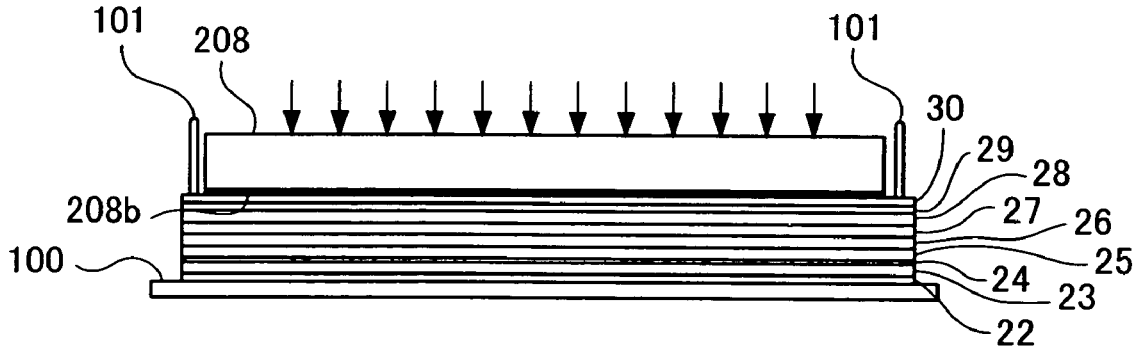
FIG. 16 is an explanatory view showing the step of applying pressure which is adopted by a manufacturing method of an ink-jet head according to a second embodiment of the present invention.

In the step of applying pressure, as illustrated in FIG. 16, a pressure jig 208 is placed on an ink ejection face of the nozzle plate 30. The pressure jig 208 is placed such that its lower flat face as a pressure application face 208*b* is in contact with the nozzle plate 30 with a liquid-repellent film 207 being interposed therebetween. The pressure jig 208 applies pressure to the metal plates when driven by a driver (not illustrated).

Figure 17:
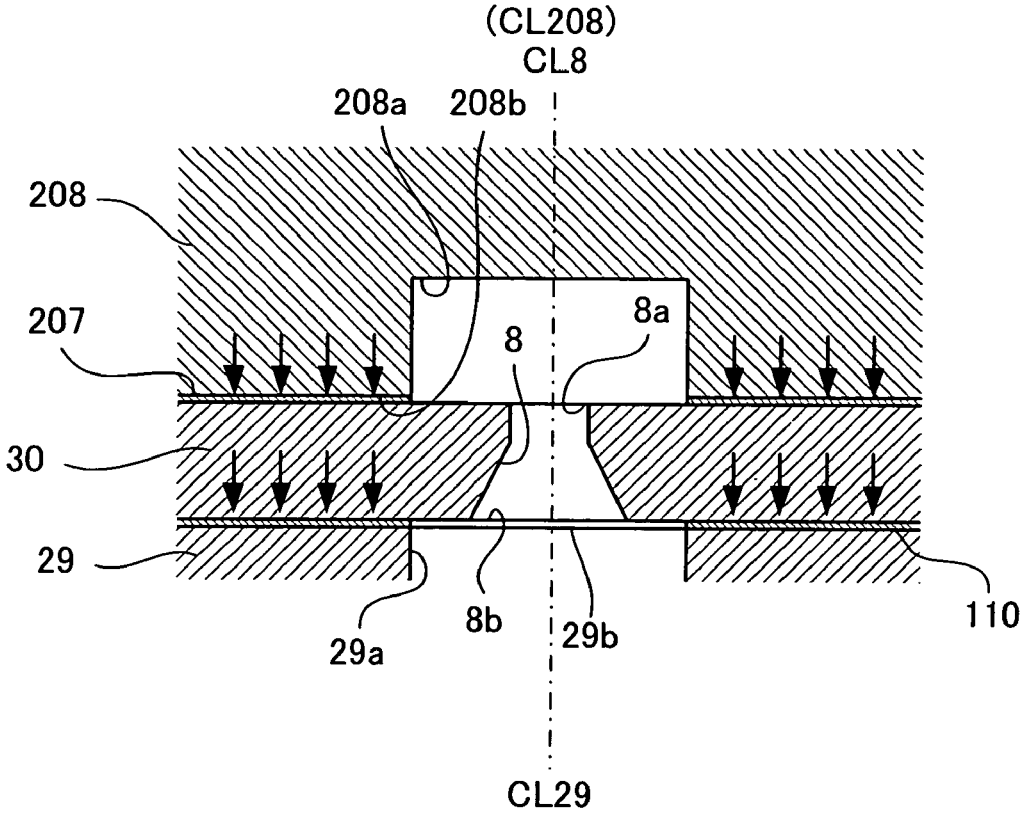
FIG. 17 is an enlarged sectional view around the nozzle hole during the step of applying pressure shown in FIG. 16.

As illustrated in FIG. 17, the pressure application face 208*b* has many recesses 208*a*. In a plan view, size, shape, and position of the recesses 208*a* of the pressure application face 208*b* are the same as those of communication holes 29*a* of the cover plate 29. The pressure jig 208 is placed on the nozzle plate 30 such that the recesses 208*a* correspond to the respective nozzle holes 8 of the nozzle plate 30, in other words, a centerline CL208 of each recess 208*a* aligns with a centerline CL8 of each nozzle hole 8.

When the pressure jig 108 is driven, pressure is transmitted to the ink ejection face of the nozzle plate 30. Here, overhangs of the nozzle plate 30 formed around the communication holes 29*a* do not receive pressure, because the pressure is not applied to portions of the nozzle plate 30 corresponding to the recesses 208*a* of the pressure jig 208.

Figure 18:
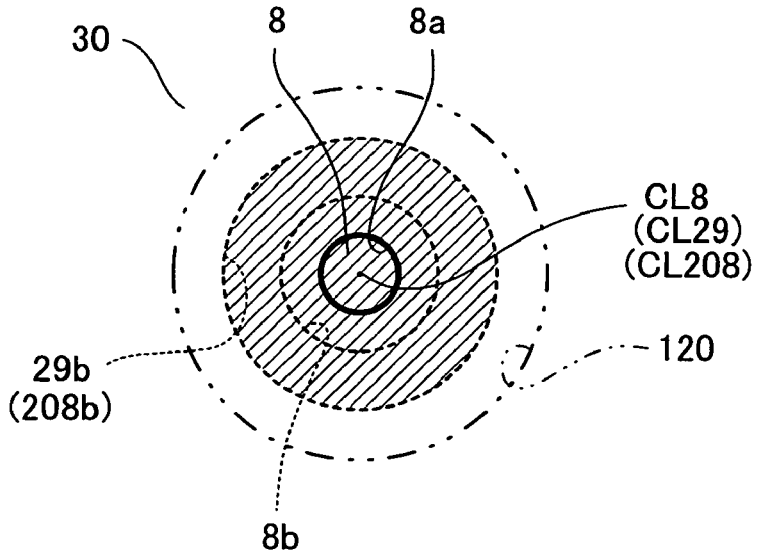
FIG. 18 is a top view of the nozzle hole during the step of applying pressure shown in FIG. 16, as seen from the side of the ink ejection face.

Consequently, as illustrated in FIG. 18, a whole region (as hatched in FIG. 18) inside an opening 29*b* of the communication hole 29*a* does not receive pressure during the step of applying pressure, while an annular region sandwiched between the hypothetical circle 120 and a circle defining the opening 29*b* and receives pressure, as is similar to the first embodiment shown in FIG. 13. The metal plates under such pressure are subjected to a heat treatment, through which the adhesive is cured to bond the metal plates.

Through these steps, the step of bonding is finished. Actuator units 21 formed through a separate step is assembled to the passage unit 4, and thus the ink-jet head 1 is obtained.

As thus far described above, in the manufacturing method according to the second embodiment as well as the first embodiment of the present invention, the overhangs of the nozzle plate 30 formed around the communication holes 29*a* do not receive pressure. Accordingly, an adhesive 110 existing between the nozzle plate 30 and the cover plate 29 can be prevented from bulging into the communication holes 29*a* and flowing into the nozzle hole 8.

Further, since this embodiment employs the pressure jig 208 having the recesses 208*a*, a reduced number of jigs are required in the step of applying pressure.

The liquid-repellent film 207 is formed on the pressure application face 208*b* of the pressure jig 208. This can prevent adhering of an extra adhesive to the pressure application face 208*b* of the pressure jig 208.

In the first and second embodiments, the hatched region in FIGS. 13 and 18 (which locates inside the opening 29*b* of the communication hole 29*a*) does not receive pressure during the step of applying pressure, while the annular region sandwiched between the hypothetical circle 120 and the circle defining the opening 29*b* of the communication hole 29*a* receives pressure. However, a region to which pressure is applied is not limited to the above, as long as pressure is applied to a part of the region in the ink ejection face sandwiched between the circle defining the opening 29*b* of the communication hole 29*a* and the hypothetical circle 120. The relief hole 106*a* or the recess 208*a* is provided at a position corresponding to the non-pressurized region which is arbitrarily defined as mentioned above.

Figure 19:
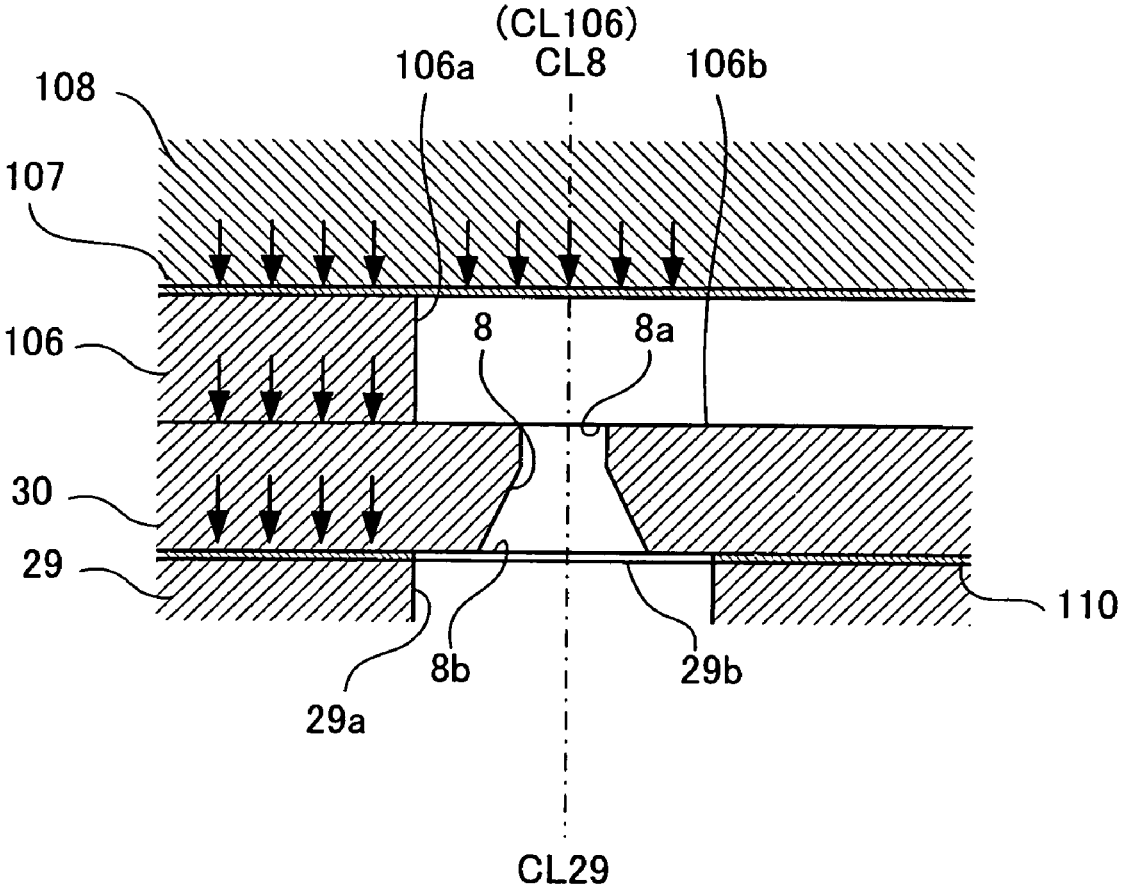
FIG. 19 is an enlarged sectional view around the nozzle hole during the step of applying pressure according to a modification.

As illustrated in FIG. 19, pressure may be applied to, not a whole of the annular region, only a part of the annular region. In this case, pressure applied to the overhangs of the nozzle plate 30 formed around the communication holes 29*a* is surely weakened, and thus bulging of the adhesive 110 can be prevented more reliably.

In the step of laminating, it is not always necessary to laminate the nozzle plate 30 and the cover plate 29 with the centerline CL8 of the nozzle hole 8 aligning with the centerline CL29 of the communication hole 29*a*. For example, the centerlines CL8 and CL29 may not be aligned but merely parallel.

The hypothetical circle, based on which a range of pressure application is determined, may be, in the ink ejection face, concentric with the opening 8*b* of the nozzle hole 8 and have a radius of twice larger than the average distance from the center of the opening 8*b* to a line of intersection of the interface between the nozzle plate 30 and the cover plate 29 and the sidewall of the communication hole 29*a*.

Although in the first embodiment the resin sheet 107 is placed on the pressure plate 106 in the step of preparing for pressure application, the resin sheet 107 is not necessarily provided.

In the steps of laminating and preparing for pressure application of the first embodiment, the cover plate 29, the nozzle plate 30, and the pressure plate 106 are positioned to one another based on the positioning holes 90 of these plates and the positioning pins of the lamination jig 99. However, other ways of positioning are also acceptable. For example, the metal plates may not have the positioning holes 90 and alternatively may be set within a member.

In the second embodiment, the liquid-repellent film 207 is formed on the pressure application face 208*b* of the pressure jig 208, but the liquid-repellent film 207 may not necessarily be provided.

In a state where the nozzle plate 30 and the cover plate 29 are put in layers, the centerline of the nozzle hole 8 may incline with respect to the centerline of the communication hole of the cover plate. For example, the nozzle hole may be formed oblique with respect to the plane of the nozzle plate.

The following is also acceptable. That is, on the interface between the nozzle plate 30 and the cover plate 29, there is defined a region sandwiched between an outer edge of an opening of the communication hole and a hypothetical circle whose center locates at a point where the centerline of the nozzle hole intersects the interface and whose radius is 1.5 times larger than the average distance from the aforesaid center to the outer edge of the opening of the communication hole on the interface, and this defined region is projected along the thickness of the nozzle plate 30 onto the ink ejection face so that a region is defined on the ink ejection face. Pressure may be applied to a part of this region on the ink ejection face. In other words, an opening of the communication hole on the interface between the nozzle plate 30 and the cover plate 29, i.e., on the side of the nozzle plate 30 opposite to the ink ejection face, is projected onto the ink ejection face, and pressure is applied to a part of a region that is sandwiched between a circle corresponding to the projected image and the hypothetical circle.

A shape of the nozzle hole 8 may be modified in various ways. An outer edge of the opening 8*a* or 8*b* of the nozzle hole 8 may be, instead of circle, ellipse, triangle, rectangle, etc. The communication hole 29*a* may also have various shapes.

When, though the communication hole 29*a* has a cylindrical shape, the centerline CL8 of the nozzle hole 8 and the centerline CL29 of the communication hole 29*a* do not align or when the communication hole 29*a* does not have a cylindrical shape, "the distance from the center of the opening 8*b* of the nozzle hole 8 to a line of intersection of the interface between the nozzle plate 30 and the cover plate 29 and the sidewall of the communication hole 29*a*" may not be constant throughout the sidewall of the communication hole 29*a*. When this occurs, an averaged distance is available.

The application of the present invention is not limited to printers, but the present invention is applicable also to ink-jet heads of ink-jet type facsimiles or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A manufacturing method of an ink-jet head, comprising the steps of:

layering with an adhesive a first plate having a nozzle hole that ejects an ink droplet and a second plate having a communication hole so that, on an interface between the first plate and the second plate, an opening of the nozzle hole is included within an opening of the communication hole; and applying pressure to the first and second plates in their layered direction so that the pressure is applied to only a region outside of the opening of the communication hole with respect to a plane parallel to planes of the first and second plates, wherein the step of applying pressure occurs after the step of layering and in the absence of any pressure causing the adhesive to enter into the nozzle hole having been previously applied;

wherein, in the step of applying pressure, pressure is applied to the first and second plates so that the pressure is applied to a part of a region sandwiched between the outer edge of the opening of the communication hole and a first circle that is concentric with the opening of the nozzle hole and has a radius of twice larger than an average distance from a center of the opening of the nozzle hole to a line of intersection of the interface and a sidewall of the communication hole;

wherein:

the opening of the communication hole has a circular shape; and in the step of applying pressure, pressure is applied to the first and second plates so that the pressure is applied to a part of a region sandwiched between the first circle and a second circle that defines the opening of the communication hole; and wherein:

the first plate has an ink ejection face, from which an ink droplet is ejected, opposite to the interface;

the step of layering further comprises the step of preparing for pressure application in which a third plate having any one of a recess and a relief hole is layered on the ink ejection face of the first plate so that the first plate is intervened between the second and third plates and so that a centerline of any one of the recess and the relief hole aligns with the centerline of the nozzle hole, an opening of any one of the recess and the relief hole having a radius equal to or larger than the radius of the second circle and equal to or smaller than the radius of the first circle; and in the step of applying pressure, pressure is applied via the third plate to the first and second plates.

2. The manufacturing method according to claim 1, wherein, in the step of preparing for pressure application, a resin sheet is put on the third plate so that the third plate is intervened between the resin sheet and the first plate.

3. The manufacturing method according to claim 2, wherein the resin sheet is a liquid-repellent film formed on the third plate.

4. The manufacturing method according to claim 1, wherein, in the step of preparing for pressure application, the third plate and the first plate are layered with each other on the basis of positioning holes that are provided in the respective first, second, and third plates.

5. The manufacturing method according to claim 1, wherein the third plate and the second plate are parts equalized with each other.

6. A manufacturing method of an ink-jet head, comprising the steps of:

layering with an adhesive a first plate having a nozzle hole that ejects an ink droplet and a second plate having a communication hole so that, on an interface between the first plate and the second plate, an opening of the nozzle hole is included within an opening of the communication hole; and applying pressure to the first and second plates in their layered direction so that the pressure is applied to only a region outside of an outline with respect to a plane parallel to planes of the first and second plates, the outline being formed by projecting an outer edge of the opening of the communication hole on the interface along a thickness of the first plate onto an ink ejection face of the first plate opposite to a face thereof bonded to the second plates, wherein the step of applying pressure occurs after the step of layering and in the absence of any bonding pressure causing the adhesive to enter into the nozzle hole having been previously applied;

wherein, in the step of applying pressure, pressure is applied to the first and second plates so that the pressure is applied to a part of a first region which is formed by projecting a second region on the interface along a thickness of the first plate onto the ink ejection face, the second region being sandwiched between the outer edge of the opening of the communication hole and a hypothetical circle whose center locates at a point where the centerline of the nozzle hole intersects the interface and whose radius is 1.5 times larger than an average distance from the center to the outer edge of the opening of the communication hole on the interface; and wherein:

the opening of the communication hole on the interface has a circular shape;

the step of layering further comprises the step of preparing for pressure application in which a third plate having any one of a recess and a relief hole is layered on the ink ejection face of the first plate so that the first plate is intervened between the second and third plates and so that a centerline of any one of the recess and the relief hole aligns with the centerline of the nozzle hole, an opening of any one of the recess and the relief hole having a radius equal to or larger than the radius of the opening of the communication hole on the interface and equal to or smaller than the radius of the hypothetical circle; and in the step of applying pressure, pressure is applied via the third plate to the first and second plates.

7. The manufacturing method according to claim 6, wherein: the third plate and the second plates are parts equalized with each other; and in the step of preparing for pressure application, a resin sheet is put on the third plate so that the third plate is intervened between the resin sheet and the first plate.

* * * * *

UNITED STATES PATENT AND TRADEMARK OFFICE

CERTIFICATE OF CORRECTION

PATENT NO. : 7,600,317 B2
APPLICATION NO. : 11/157988
DATED : October 13, 2009
INVENTOR(S) : Matsuyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 573 days.

Signed and Sealed this

Fifth Day of October, 2010

David J. Kappos

David J. Kappos
*Director of the United States Patent and Trademark Office*